United States Patent [19]

Nagasaki et al.

[11] Patent Number: 4,649,642

[45] Date of Patent: Mar. 17, 1987

[54] TRIMMER CONSTRUCTION FOR ELECTRIC SHAVERS

[75] Inventors: Haruki Nagasaki, Hikone; Masami Kitamura, Shiga; Yoji Iguchi, Hikone, all of Japan

[73] Assignee: Matsushita Electric Works, Ltd., Japan

[21] Appl. No.: 790,799

[22] Filed: Oct. 24, 1985

Related U.S. Application Data

[63] Continuation of Ser. No. 613,726, May 24, 1984, abandoned.

[30] Foreign Application Priority Data

Jun. 10, 1983 [JP] Japan ..... 58-104563

[51] Int. Cl.[4] ..... B26B 19/10

[52] U.S. Cl. ..... 30/34.1; 30/43.92; 74/53

[58] Field of Search ..... 30/34.1, 43.92, 43.9; 74/49, 50

[56] References Cited

U.S. PATENT DOCUMENTS 3,552,007 1/1971 Yamada ..... 30/34.1
4,065,977 1/1978 Buzzi et al. ..... 30/43.92
4,167,060 9/1979 Sakamoto ..... 30/43.92
4,283,848 8/1981 Messinger et al. ..... 30/34.1

*Primary Examiner*—Douglas D. Watts
*Attorney, Agent, or Firm*—Stevens, Davis, Miller & Mosher

[57] ABSTRACT

A reduced thickness trimmer unit for electric shavers is mounted within and partly on a head casing. The unit has a frame, a stationary cutter on one end and a movable cutter which cooperates with the stationary cutter. The frame contains a resilient leg which extends interiorly thereof and within the plane thereof so as to resiliently support at its free end a coupling element for connection with the movable cutter. The coupling element engages with an eccentric cam carried on the driving shaft of the motor so that it is driven by the driving shaft to reciprocate relative to the frame within the plane of the frame as the resilient leg limits the coupling element to move in the reciprocating direction within the plane of the frame. The resilient leg and the coupling element combine to convert rotary motion of the driving shaft into reciprocatory motion of the movable cutter in the trimmer unit and are received within the thickness of the frame. This yields a very compact arrangement of the trimmer unit with respect to the thickness thereof.

3 Claims, 18 Drawing Figures

TRIMMER CONSTRUCTION FOR ELECTRIC SHAVERS

This application is a continuation of application Ser. No. 613,726, filed May 24, 1984 now abandoned.

BACKGROUND OF THE DISCLOSURE

1. Field of the Invention

The present invention is directed to a trimmer construction for electric shavers, and, more particularly, to a trimmer unit adapted in use to be incorporated in electric shavers with or without a main cutter.

2. Description of the Prior Art

A trimmer unit adapted to electric shavers with a main cutter is well known, for example, as disclosed in U.S. Pat. No. 3,552,007. In that patent, a trimmer unit is disposed adjacent the main cutter and operated directly from the drive source for the main cutter. As seen in this patent, the prior trimmer unit is basically composed of two members disposed in a stacking arrangement with one another. One is a trimmer base mounted on the housing of the shaver and carrying at the end stationary and movable cutters, and the other is a trimmer drive member mounted on the trimmer base for connection with the drive source of the main cutter and the movable cutter in such a way as to reciprocate the movable cutter upon receiving the driving force from the drive source. In view of that, certain thickness is required for each of the trimmer base and the trimmer drive member to impart sufficient mechanical strength thereto. The above stacking arrangement of the parts results in an increased thickness of the trimmer unit; this counteracts the demand for reducing the thickness of the trimmer unit or incorporating it in the shaver without adding extra or undue thickness thereto. In addition to the above, the trimmer drive member employed in the prior art shavers is normally in the form of a lever which is pivoted to the trimmer base by means of a pin with one end thereof connected to the movable cutter and with the other end thereof being in engagement with the drive source of the main cutter. As a result of this arrangement, the movable cutter is driven to reciprocate as the pivoted lever is operated by the driving source to pivot about the pin. Consequently, the prior art shavers have the drawback of suffering friction noises resulting from the mechanical linkage between the lever and the trimmer base, and particularly resulting from the pivotal movement of the driving element about the pin and/or associated sliding movement of the lever on the trimmer base. In connection with the above, the trimmer unit employed in prior art shavers requires a large number of parts including the above lever and linkage thereof which are assembled only with difficulty.

SUMMARY OF THE INVENTION

The above shortcomings have been eliminated by the present invention which comprises a trimmer unit carried within and partly on a head casing and a motor in the head casing for the trimmer unit. The head casing is provided with a base plate section below which the motor is received and through which the driving shaft of the motor extends upwardly for connection with the trimmer unit. Said trimmer unit comprises a frame mounted on the base plate section, a stationary cutter fixed on one end thereof and a movable cutter in sliding contact with the stationary cutter. Included in the frame is resilient leg means which extends interiorly and within the plane thereof so as to resiliently support at its free end a coupling element for connection with the movable cutter. The coupling element thus supported is permitted to move relative to the frame so that it can be driven by the driving shaft to reciprocate within the plane of the frame. Formed in the coupling element is a slot in which said driving shaft extends. Said slot is engageable with an eccentric cam on the driving shaft such that the rotational motion of the driving shaft can be converted into reciprocating motion of the coupling element or the movable cutter when the cam is in engagement with the slot. With this arrangement in which the resilient means, as well as the coupling means supported thereby, are disposed to be movable within the plane or thickness of the frame, the trimmer unit requires no moving part on or below the frame for establishing driving connection from the driving shaft to the movable cutter. This is advantageous in that such moving part would certainly add extra thickness to the trimmer unit.

Accordingly, it is a primary object of the present invention to provide a trimmer unit for electric shavers having a reduced thickness, enabling the shaver with the trimmer unit to be compact in size.

In a preferred embodiment, said resilient leg means and coupling element are integrally molded with the frame to eliminate the necessity of any additional parts for interconnection thereof, thus reducing the number of parts employed in the trimmer unit and the mechanical noise resulting from the friction engagement between the moving parts. Additionally, the resilient leg means serves to absorb an undesirable vibration of the frame which would also cause noise.

It is therefore another object of the present invention to provide a trimmer unit for electric shavers which is capable of being easily assembled as well as being operated at a greatly reduced noise level.

Said frame of the trimmer unit is slidably mounted on the base plate section of the head casing such that it is movable between a projected position where it is projected outwardly of the head casing and a retracted position where it is retracted inwardly thereof. Said slot is elongate in the direction of the movement between the projected and retracted positions and is formed at its one longitudinal end with a first opening into which said eccentric cam fits for engagement with the coupling element when the frame is in the projected position and at the other end with a second opening in which the cam rotates freely without being engaged with the coupling member. Thus, the trimmer unit can be out of operative arrangement with the driving shaft when it is in the retracted position.

It is therefore a further object of the present invention to provide a trimmer unit for electric shavers, in which the trimmer unit can remain inoperative when the main cutter is primarily adapted for use in cutting operation, thus reducing the power requirement or consumption and the wear of the moving parts and in which the trimmer unit is retracted when out of use so as not to disturb the cutting operation by the main cutter, thus providing easy-handling performance.

In the present invention, there are disclosed still other advantageous features, such as movement of the trimmer unit for secure positioning thereof, a unique combination of a trimmer handle for the trimmer unit and the frame of the trimmer unit, and structural arrangement of the frame for imparting increased mechanical strength thereto.

These and still other objects of the present invention will be more apparent in the following detailed description of the preferred embodiment when taken in conjunction with the attached drawings.

DETAILED DESCRIPTION OF THE PREFERRED EMBODIMENTS

The first embodiment is shown in FIGS. 1 through 11.

Figure 1:
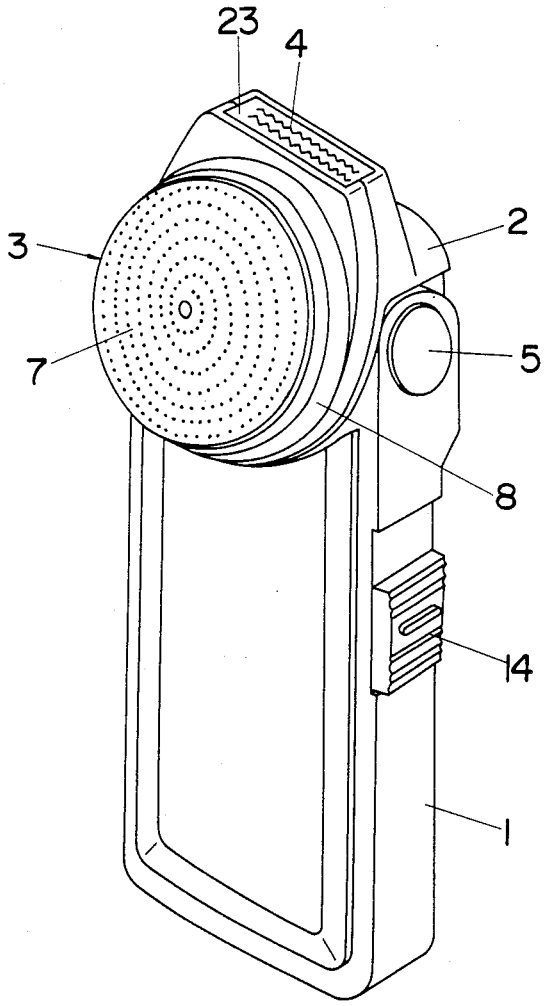
FIG. 1 is a perspective view of an electric shaver with a trimmer unit in accordance with a preferred embodiment of the present invention.

Referring now to FIG. 1, an electric shaver with a trimmer unit in accordance with the first preferred embodiment of the present invention is basically composed of a housing 1 having therein an electric battery (not shown) and a head casing 2 provided with a main cutter 3 and the trimmer unit 4. The head casing 2 is pivotally supported at the upper end of the housing 1 by a pair of pins 5 to be movable about a horizontal axis defined by the pins 5. Housed within the head casing 2 is an electric motor 6 which is energized by the battery to drive the main and trimmer cutters. A switch handle 14 is slidably mounted on the side of the housing 1 for connecting the motor 6 to the battery and disconnecting it therefrom. The head casing 2 is a hollow case formed by an open top receptacle 20, an intermediate plate 21 which defines a base plate section for mounting the trimmer unit 4 thereon and a covering plate 22. Intermediate plate or base plate section 21 is spaced from the bottom of the receptacle 20 to define therebetween a space for receiving the motor 6. Covering plate 22 is spaced from the base plate section 21 to define therebetween a space for receiving the trimmer unit 4. The front edge of the covering plate 22 defines with a cutout portion at the upper front edge of the receptacle 20 a window 23 through which the trimmer front can project outwardly. Said main cutter 3 is composed of a rounded shearing foil 7 integrally carried on a supporting rim 8 and a rotary cutter block (only a fraction of which is shown at 9 in FIG. 7) carrying thereon cutters extending generally in radial directions for cooperation with the shearing foil 7.

Figure 7:
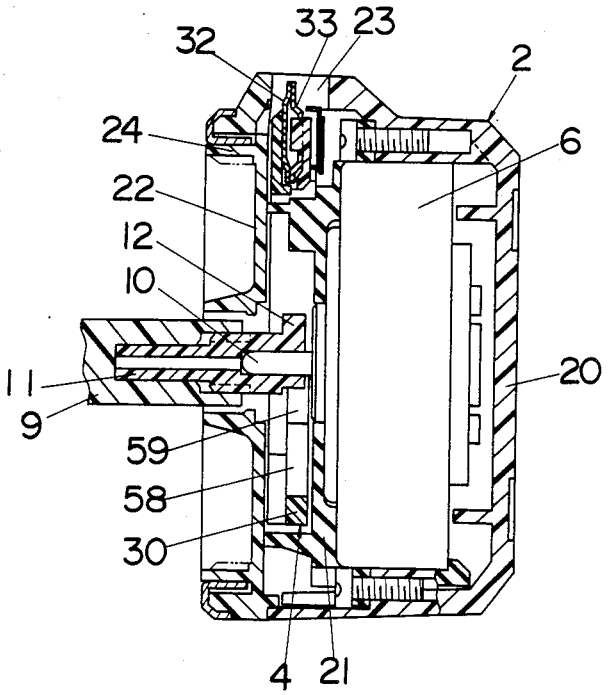
FIG. 7 is a sectional view taken along the line 7—7 of FIG. 6.

As shown in FIG. 7, the covering plate 22 has on its upper surface an annular wall 24 with internal thread with which said supporting rim 8 of the main cutter 3 is in engagement for mounting the main cutter 3 on the head casing 2. An output rotor shaft 10 of the motor 6 extends through the base plate section 21 to be force fitted in a driving shaft 11 for rotating the same. The driving shaft 11 extends through the trimmer unit 4 and covering plate 22 upwardly to be connected to the sleeve 9 depending from said rotary cutter block of the main cutter 3 for rotation of the rotary cutter block. Integrally formed on the lower end portion of the driving shaft 11 is an eccentric cam 12 which is engageable with the trimmer unit 4 for operation of the trimmer unit 4.

Figure 2:
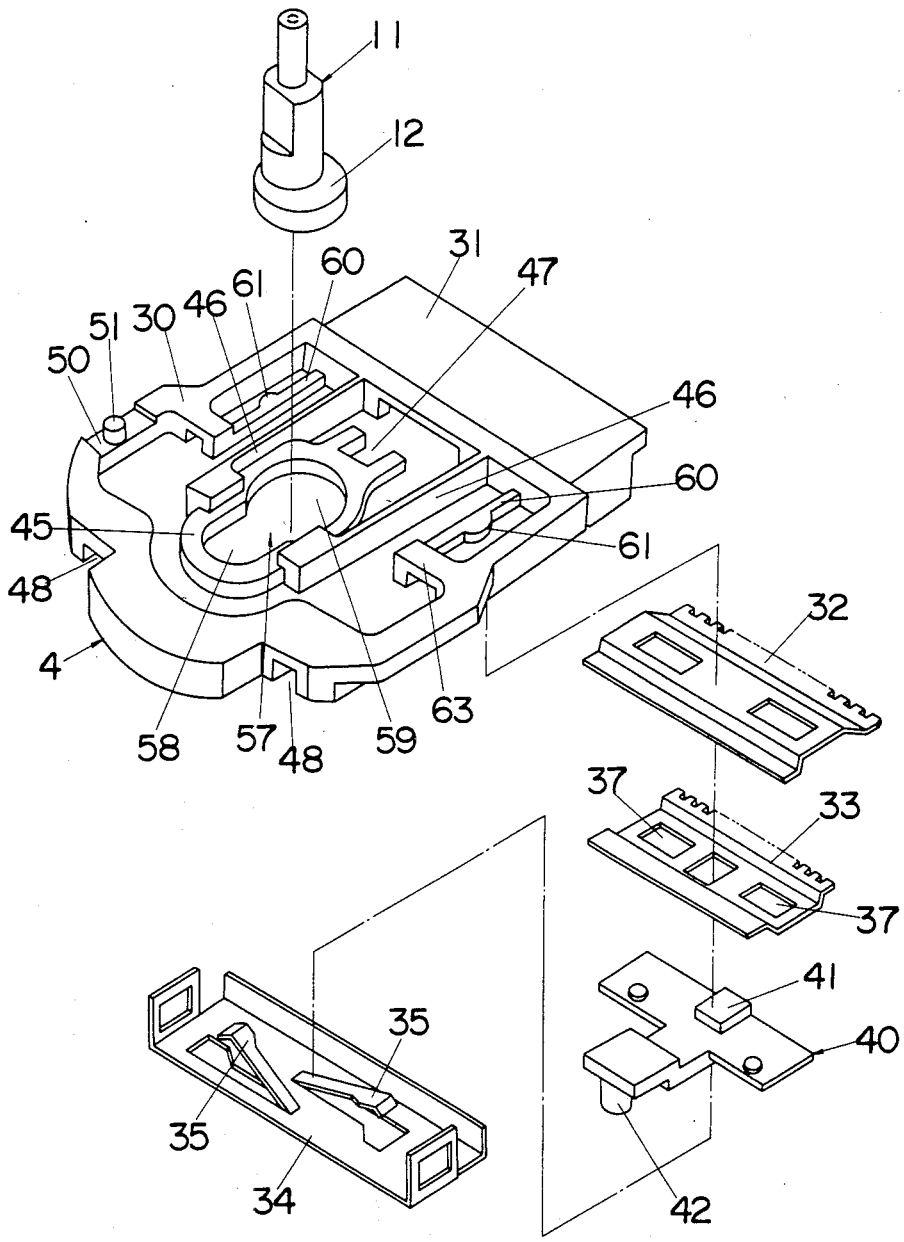
FIG. 2 is an exploded perspective view of the above trimmer unit.
Figure 4:
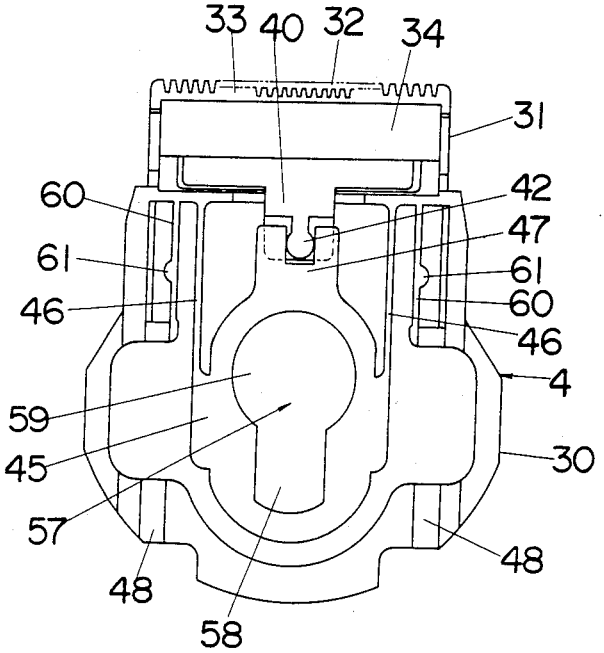
FIG. 4 is a bottom view of the above trimmer unit.
Figure 3:
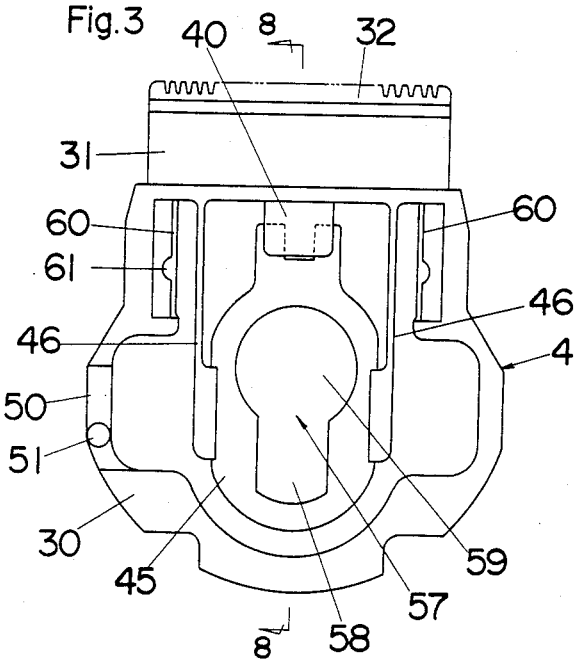
FIG. 3 is a top view of the above trimmer unit.
Figure 5:
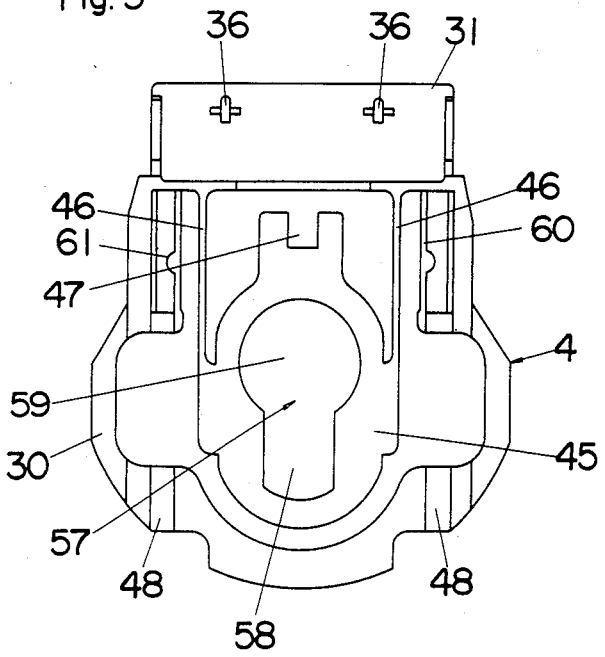
FIG. 5 is a bottom view of the above trimmer unit with stationary and movable cutters removed.
Figure 9:
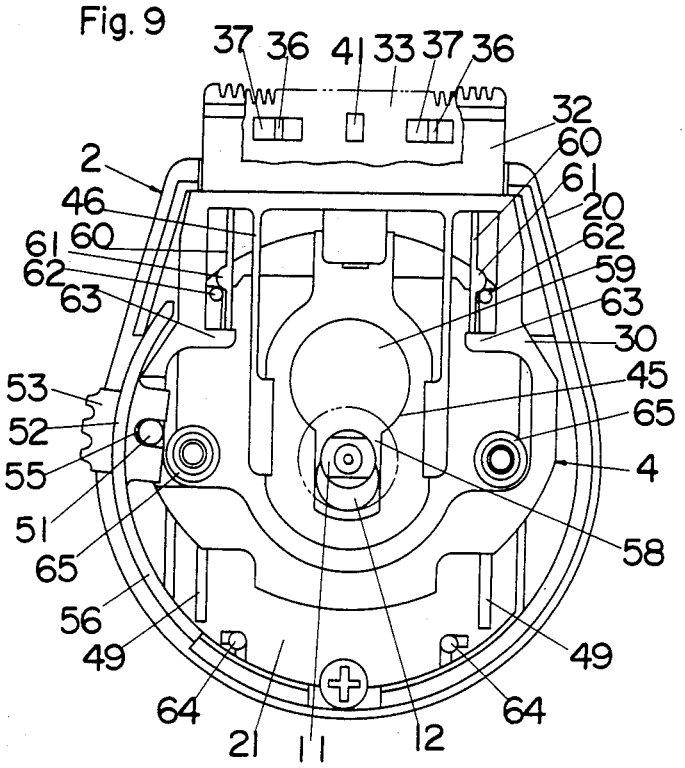
FIGS. 9 to 11 are explanatory views respectively showing the operation of the trimmer unit.

Referring to FIG. 2, said trimmer unit 4 comprises a frame 30 made of plastic material in the form of a generally closed loop with a cutter support 31 adjacent to the front member thereof, a stationary cutter 32 fixed on the underside of the support 31 and a movable cutter 33 slidably held on the underside of the support 31 to be in sliding engagement with the stationary cutter 32. A guard 34 having a pair of leaf springs 35 struck therefrom is attached to the cutter support 31 with the springs 35 urging the movable cutter 33 against the stationary cutter 32. As shown in FIGS. 5 and 9, a pair of stoppers 36 are formed on the underside of the cutter support 31 to extend through the stationary cutter 32 into the laterally elongated guide slots 37 in the movable cutter 33 within the width of which the movable cutter 33 is allowed to reciprocate, thus limiting the stroke of the movable cutter 33. Numeral 40 designates a trimmer drive member having on one end a hook 41 to be engaged with the movable cutter 33 and having on the other end a stud 42 for connection with a coupling element 45, which is resiliently supported by the frame 30 and is driven by said driving shaft 11 to reciprocate within the plane of the frame 30. Integrally formed with the frame 30 are a pair of parallel resilient legs 46 which extend inwardly in the direction generally perpendicular to the lengthwise direction of the cutters 32 and 33 from the front member of the frame 30 in order to have said coupling element 45 carried between the free ends thereof, thus permitting limited movement of the coupling element 45 relative to the frame 30. That is, the coupling element 45, when engaged with said eccentric cam 12 on the driving shaft 11, is driven to reciprocate in the direction parallel to the lengthwise direction of the cutter support 31 as the resilient legs 46 resiliently flex sidewardly upon rotation of driving shaft 11 to convert the rotary motion of the driving shaft 11 in the reciprocatory motion of the coupling element 45. The coupling element 45 has its front end portion bifurcated to define between the bifurcated ends a socket 47 for receiving said stud 42 of the trimmer drive member 40. This establishes a driving connection between the coupling element 45 and the movable cutter 33.

Said frame 30 is formed in the bottom with a pair of parallel grooves 48 into which complementary rails 49 on the base plate section 21 loosely fit for effecting a sliding movement of the frame 30 on the base plate section 21. As a result frame 30 or the trimmer unit 4 assumes a projected position where the trimmer cutter is projected out of the window 23 of the head casing 2 and a retracted position where it is retracted in the head casing 2. The side bar of the frame 30 is provided with a recess 50 within the depth of which an integral swivel pin 51 extends upwardly from its bottom for engagement with a trimmer handle 52. The trimmer handle 5 is in the form of an arcuate member with an operating knob 53 on the outer side and with an inwardly extending tongue 54 with an eye 55 with which said swivel pin 51 engages. The upper and lower portions of the arcuate member are slidably received in corresponding peripheral grooves in the receptacle 20 and the covering plate 22 (only one groove in the receptacle 20 is indicated at 56 in the figures) so as to be movable along the arcuate path with the tongue 54 connected to the swivel pin 51 on the frame 30. Accordingly, movement of the trimmer handle 50 causes the frame 30 or the trimmer unit 4 to move between said projected and retracted positions.

Figure 6:
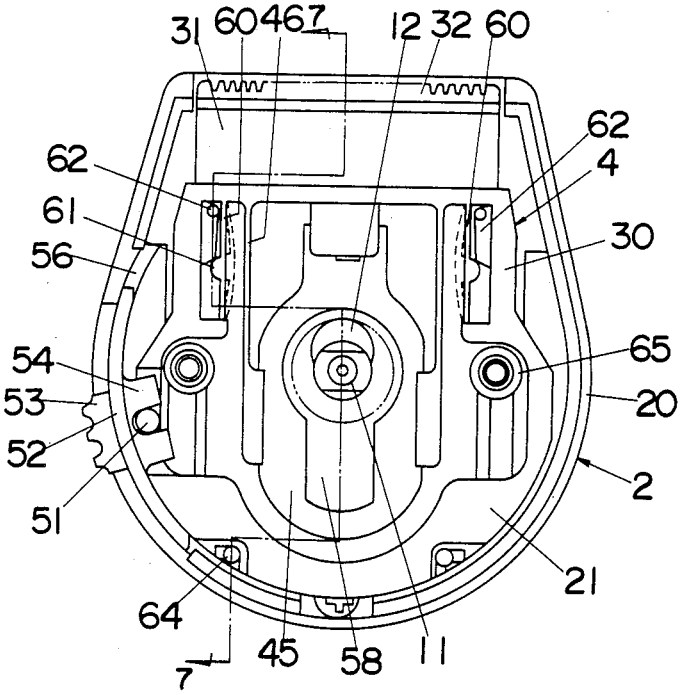
FIG. 6 is a top view of the above trimmer unit when incorporated in a head casing of the shaver.
Figure 10:
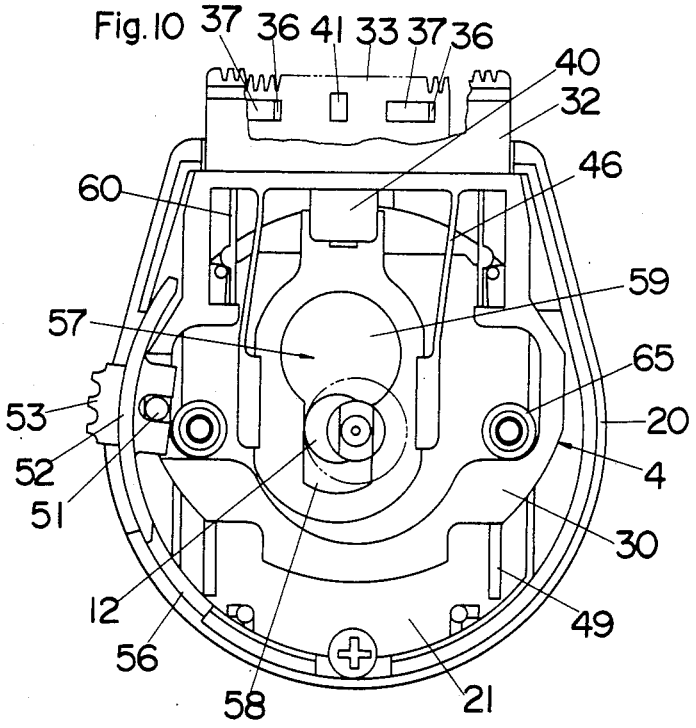
Figure 11:
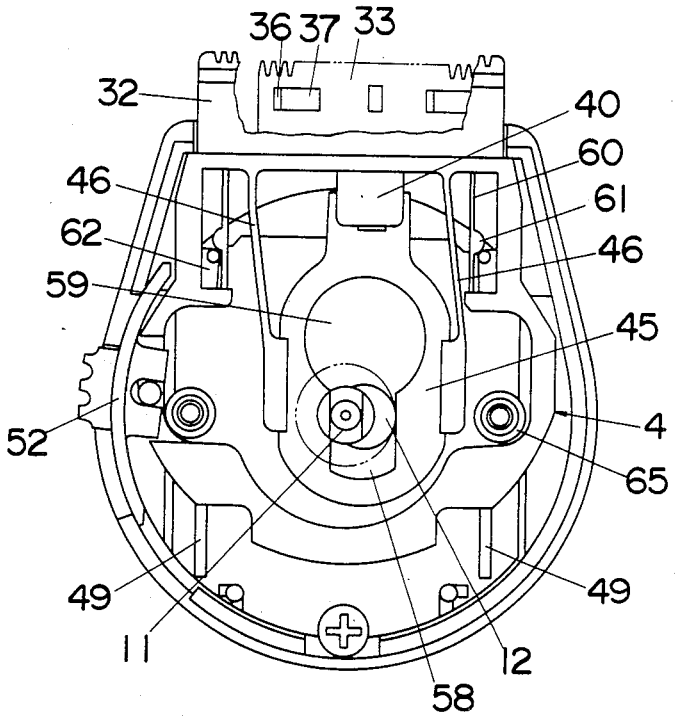

Said coupling element 45 has a slot 57 of key-hole configuration defined by first and second openings 58 and 59 aligned in the direction of sliding movement of the trimmer unit 4. The first opening 58 is for engagement with said eccentric cam 12 to establish the driving connection from the driving shaft 11 to the movable cutter 33, while the second opening 59 is for disengagement of the coupling element 45 from the cam 12 to disconnect the above-described driving connection. That is, when the trimmer unit 4 is in the retracted position, as best shown in FIG. 6, the eccentric cam 12 is in the second opening 59 to freely rotate therein such that it can only drive the rotary cutter block of the main cutter 3 without driving the movable cutter 33 of the trimmer unit 4. When the trimmer unit 4 is moved in the projected position, as shown in FIGS. 9 to 11, by the operation of the trimmer handle 52, the eccentric cam 12 comes into engagement with the first opening 58 for operations of the trimmer unit 4 as well as the main cutter 3. These figures provide an easy understanding of the manner in which the movable cutter 33 is driven to reciprocate through the linkage between the eccentric cam 12 and the coupling element 45 upon rotation of the driving shaft 11.

Figure 8:
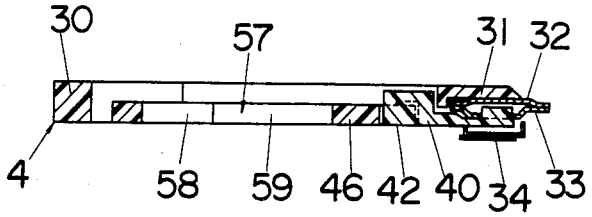
FIG. 8 is a cross section taken along the line 8—8 of FIG. 3.

The frame 30 is also provided on portions outside of each resilient leg 46 with a resilient arm 60 integrally extending in a parallel relationship with the adjacent resilient leg 46 in normal or unflexed condition so as to be capable of resiliently flexing in the direction perpendicular to its length. Formed on the outer surface of each resilient arm 60 is a rounded projection 61 which cooperates with a detent 62 on the base plate section 21 such that it cams over the detent 62 to flex the resilient arm 60 inwardly during movement of the trimmer unit 4 between the retracted and projected positions, thus adding a clicking action to the movement of the trimmer unit 4. This clicking action assures that the trimmer unit 4 can be retained in the respective positions and prevents accidental movement of the trimmer unit 4. That is, the projection 61 on each resilient arm 60 engages the rear end of the corresponding detent 62 so as to retain the trimmer unit 4 in the retracted position, as best shown in FIG. 6, while it engages the front end of the detent 62 so as to retain the unit 4 in the projected position, as best shown in FIG. 9. It is to be noted that all of said coupling element 45, resilient legs 46, resilient arms 60 are integrally molded with the frame 30 to be within the dimensions of the thickness thereof, as shown in FIGS. 2 and 8. In connection with the above, the front end of each detent 62 is in abutting engagement with the front member of the frame 30 for limiting the amount of retraction, as shown in FIG. 6, and the rear end of each detent 62 is in abutting engagement with inwardly extending rib 63 on the side member of the frame 30 for likewise limiting the amount of projection of the trimmer unit 4. Further, said resilient arms 60 serve to absorb undesired vibrations of the frame associated with reciprocating movement of the movable cutter 33. A pair of upwardly extending pegs 64 are formed on the rear of the base plate section 21 to serve also as stops for preventing excess retraction of the trimmer unit 4. Formed on the base plate section 21 are posts 65 which extend through respective spaces left between the resilient legs 46 and the side members of the frame 30 and which have respective holes for receiving screws attaching said covering plate 22 to the receptacle 20 of the head casing 20.

Figure 12:
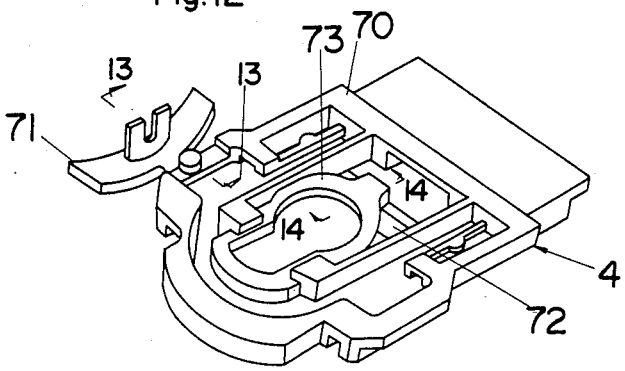
FIG. 12 is a perspective view of a modification of the above embodiment.
Figure 13:
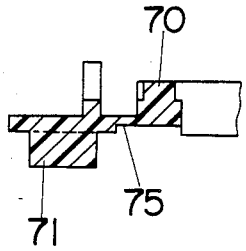
FIG. 13 is a sectional view taken along the line 13—13 of FIG. 12.
Figure 14:
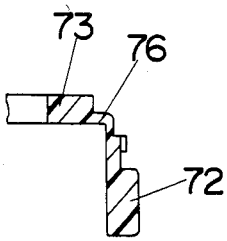
FIG. 14 is a sectional view taken along the line 14—14 of FIG. 12.
Figure 15:
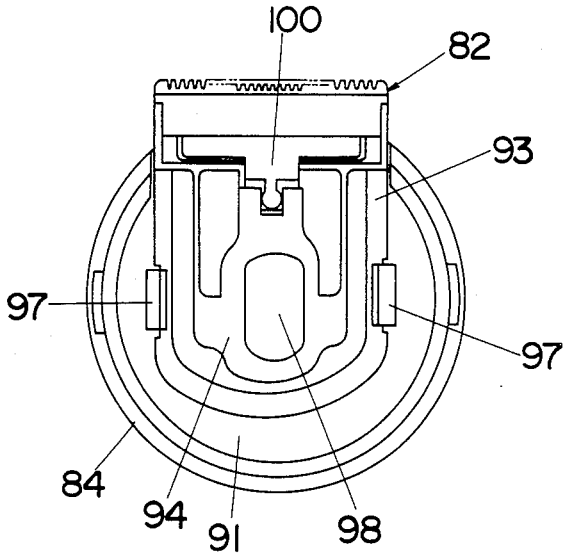
FIG. 15 is a top view of a trimmer unit when incorporated in a head casing in accordance with a second preferred embodiment of the present invention.

FIGS. 12 to 14 show a modification of the above-described embodiment which is substantially similar in construction to the above-described embodiment shown in FIG. 2 except that a trimmer handle 71 and a drive member 72 for the movable cutter are integrally formed with the frame 70 of the trimmer unit 4. That is, the trimmer handle 71 and the drive member 72 are respectively connected directly to the side member and the coupling element 73 of the frame 70 through individual webs 75 and 76 of greatly reduced thickness which provide natural hinges permitting pivotal movement of the parts 71 and 72 to compensate for undesired motions accompanying their primary motions thereof, thus assuring smooth and reliable operations thereof.

Figure 16:
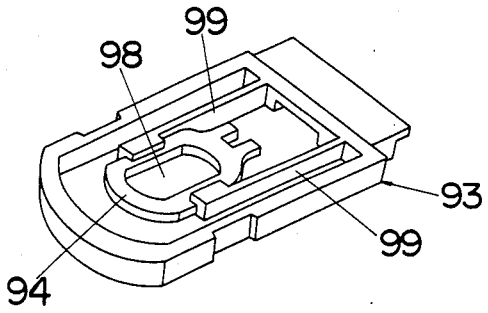
FIG. 16 is a perspective view of the above trimmer unit.
Figure 17:
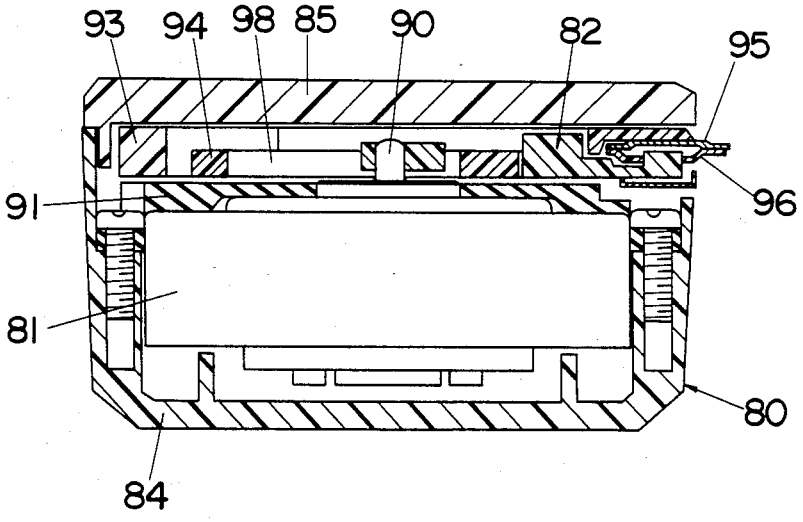
FIG. 17 is a cross sectional view of the above trimmer unit.
Figure 18:
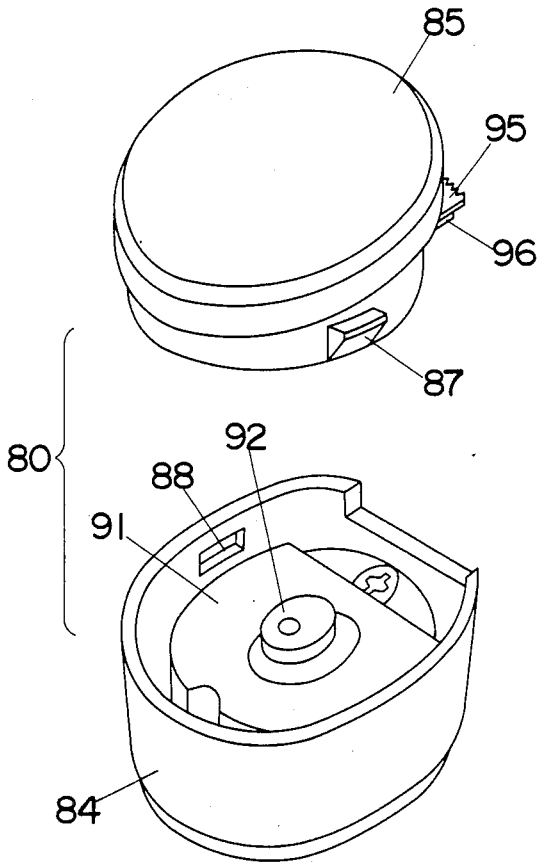
FIG. 18 is an exploded view of the above head casing.

The second embodiment is described in FIGS. 16 through 18.

This embodiment discloses a trimmer head which is adapted to be supported by a housing similar to that shown in FIG. 1. The trimmer head comprises a head casing 80 to be connected to the housing, a motor 81 powered by a battery in the housing and a trimmer unit 82. The head casing 80 is composed of an open top receptacle 84 and a top cover 85 carrying thereunder said trimmer unit 82, with said top cover 85 being detachably connected to the receptacle 84 with hooks 87 on the skirt thereof snapped in corresponding recesses 88 in the inner surface of the peripheral wall of the receptacle 84. The motor 81 is received within the receptacle 84 with its output rotor shaft 90 extending upwardly through a base plate 91 to be connected to an eccentric cam 92 for driving the same. Said trimmer unit 82 comprises a plastic frame 93 of generally the same construction as that of the first embodiment except that it is fixedly held with respect to the top cover 85 and has a coupling element 94 constantly engaging the eccentric cam 92 for effecting the reciprocating or sliding movement of a movable cutter 96 along a stationary cutter 95. Downwardly extending from the top cover 85 are a pair of clamps 97 which hold therebetween the frame 93 or the trimmer unit 82 in position. A slot 98 in the coupling element 94 is designed to be in constant engagement with the eccentric cam 92. It is of course that a pair of resilient legs 99 for resiliently supporting the coupling element 94 and a drive member 100 interconnecting the coupling element 94 and the movable cutter 96 are integral with the frame 93 and within the thickness thereof.

Although the present invention has been described in its preferred embodiments, it should be understood by those skilled in the art that the present invention is not limited to the present embodiments and various changes and modifications may be made without departing the scope of the present invention.

What is claimed is:

1. A trimmer for electric shavers which comprises:

a head casing carrying therein a trimmer unit;

a driving shaft for the trimmer unit;

said head casing having a base plate section through which the driving shaft extends upwardly;

said trimmer unit comprising a frame made of a plastic material and mounted on the base plate section, a stationary cutter fixed on a cutter support formed at one end of the frame in a plane parallel to said base plate section, a movable cutter in parallel sliding engagement with the stationary cutter, and a pair of integral resilient leg means integrally molded with the frame and a coupling element, said leg means extending interiorly and within the plane of the frame to resiliently support at their free ends said coupling element, said coupling element being releasably connected to the movable cutter to be movable therewith on a plane parallel thereto and having therein a slot with which an eccentric cam formed on the driving shaft is in engagement for effecting the reciprocating motion of the coupling member and the movable cutter connected thereto upon rotation of the driving shaft;

said slot comprising a first opening with which said eccentric cam member comes into engagement for effecting reciprocating motion of the coupling member and the movable cutter connected thereto upon rotation of the driving shaft and a second opening within which the eccentric cam member rotates freely for disengaging the driving connection between the driving shaft and the coupling element, said coupling element being slidably mounted on the frame for movement toward and away from the movable cutter, the mounting being such that when the coupling element is in a projected position the eccentric cam member is in engagement with the first opening in the coupling element and such that when it is in the retracted position the eccentric cam is received in the second opening, thus enabling the cutting unit to be selectively driven; and a trimmer operating handle connected to the coupling element for manually moving the coupling element toward and away from the movable cutter, said trimmer including clicking means which cooperate with complementary members on the base plate such that the trimmer unit clicks in and out of said projected position, said frame including a further resilient arm integrally molded and movable with the frame, said base plate section including a detent formed thereon, said resilient arm including a projection extending towards said base plate section, said projection and said detent comprising said clicking means.

2. A trimmer for electric shavers which comprises:

a head casing carrying therein a trimmer unit;

a driving shaft for the trimmer unit;

said head casing having a base plate section through which the driving shaft extends upwardly;

said trimmer unit comprising a frame mounted on the base plate section, a stationary cutter fixed on one end of the frame in a plane parallel to said base plate section, a movable cutter in parallel sliding engagement with the stationary cutter, and a pair of integral resilient leg means integrally molded with the frame and extending interiorly and within the plane of the frame to resiliently support at their free ends a coupling element, said coupling element being releasably connected to the movable cutter to be movable therewith parallel thereto and having therein a slot with which an eccentric cam formed on the driving shaft is in engagement for effecting the reciprocating motion of the coupling member and the movable cutter connected thereto upon rotation of the driving shaft;

said slot comprising a first opening with which said eccentric cam member comes into engagement for effecting reciprocating motion of the coupling member and the movable cutter connected thereto upon rotation of the driving shaft and a second opening within which the eccentric cam member rotates freely for disengaging the driving connection between the driving shaft and the coupling element, said coupling element being slidably mounted on the frame for movement toward and away from the movable cutter, the mounting being such that when the coupling element is in a projected position the eccentric cam member is in engagement with the first opening in the coupling element and such that when it is in the retracted position the eccentric cam is received in the second opening, thus enabling the cutting unit to be selectively driven; and a trimmer operating handle connected to the coupling element for manually moving the coupling element toward and away from the movable cutter, said trimmer including clicking means which cooperate with complementary members on the base plate such that the trimmer unit clicks in and out of said projected position, said frame including a further resilient arm integrally molded and movable with the frame, said base plate section including a detect formed thereon, said resilient arm including a projection extending towards said base plate section, said projection and said detent comprising said clicking means.

3. A trimmer for electric shavers which comprises:

a head casing carrying therein a trimmer unit;

a driving shaft for the trimmer unit;

said head casing having a base plate section through which the driving shaft extends upwardly;

said trimmer unit comprising a frame made of a plastic material and mounted on the base plate section, a stationary cutter fixed on a cutter support formed at one end of the frame in a plane parallel to said base plate section, a movable cutter in parallel sliding engagement with the stationary cutter, and a pair of integral resilient leg means integrally molded with the frame and a coupling element, said leg means extending interiorly and within the plane of the frame to resiliently support at their free ends said coupling element, said coupling element being releasably connected to the movable cutter to be movable therewith parallel thereto and having therein a slot with which an eccentric cam formed on the driving shaft is in engagement for effecting the reciprocating motion of the coupling member and the movable cutter connected thereto upon rotation of the driving shaft;

said slot comprising a first opening with which said eccentric cam member comes into engagement for effecting reciprocating motion of the coupling member and the movable cutter connected thereto upon rotation of the driving shaft and a second opening within which the eccentric cam member rotates freely for disengaging the driving connection between the driving shaft and the coupling element, said coupling element being slidably mounted on the frame for movement toward and away from the movable cutter, the mounting being such that when the coupling element is in a projected position the eccentric cam member is in engagement with the first opening in the coupling element and such that when it is in the retracted position the eccentric cam is received in the second opening, thus enabling the cutting unit to be selectively driven; and a trimmer operating handle connected to the coupling element for manually moving the coupling element toward and away from the movable cutter, said trimmer including clicking means which cooperate with complementary members on the base plate such that the trimmer unit clicks in and out of said projected position, said frame including a further resilient arm integrally molded and movable with the frame, said base plate section including a detent formed thereon, said resilient arm including a projection extending towards said base plate section, said projection said detent comprising said clicking means.

* * * * *